US006606836B2

(12) United States Patent
Miller

(10) Patent No.: US 6,606,836 B2
(45) Date of Patent: Aug. 19, 2003

(54) FLEXIBLE LINER FOR A CONCRETE CONTAINER

(76) Inventor: Elmer Jefferson Miller, 370 Plymouth St., Bridgewater, MA (US) 02324

( * ) Notice: Subject to any disclaimer, the term of this patent is extended or adjusted under 35 U.S.C. 154(b) by 112 days.

(21) Appl. No.: 09/792,333

(22) Filed: Feb. 26, 2001

(65) Prior Publication Data

US 2002/0148194 A1 Oct. 17, 2002

Related U.S. Application Data

(63) Continuation-in-part of application No. 09/347,090, filed on Jul. 2, 1999, now Pat. No. 6,202,370.

(51) Int. Cl.[7] ..... E04H 14/00

(52) U.S. Cl. ..... 52/741.14; 52/169.14; 52/169.7; 52/746.1; 52/265; 405/129.55; 405/129.75; 405/129.95

(58) Field of Search ..... 52/169.14, 741.14, 52/169.6, 169.7, 265, 746.1, 169.12, 169.13, 741.11, 21; 405/129.55, 129.6, 129.75, 129.1, 129.95

(56) References Cited

U.S. PATENT DOCUMENTS 2,083,491 A * 6/1937 Chaffee ..... 249/27
2,382,171 A * 8/1945 Pomykala ..... 73/49.2
2,807,071 A * 9/1957 Francis et al. ..... 249/27
3,263,378 A * 8/1966 Dorris
3,596,419 A * 8/1971 Jalbert
3,938,773 A * 2/1976 Duwe et al. ..... 249/27
4,388,357 A * 6/1983 Luebke
4,467,587 A * 8/1984 Montagnan
4,653,663 A * 3/1987 Holtsclaw
4,934,122 A * 6/1990 Linquist
5,126,095 A * 6/1992 Crosno et al.
5,157,888 A * 10/1992 Lindquist
5,191,785 A * 3/1993 Kidd et al. ..... 73/49.2
5,246,308 A * 9/1993 Brothers ..... 405/53
5,443,327 A * 8/1995 Akkala et al. ..... 405/118
5,656,766 A * 8/1997 Horn et al.
5,763,735 A * 6/1998 Stahl ..... 588/16
6,195,944 B1 * 3/2001 Goldthorpe ..... 52/19
6,202,370 B1 * 3/2001 Miller et al. ..... 52/169.14
6,238,137 B1 * 5/2001 Whitworth et al. ..... 405/38

* cited by examiner

*Primary Examiner*—Lanna Mai
*Assistant Examiner*—Dennis L. Dorsey

(57) ABSTRACT

The present invention is method and resulting assembly for applying a flexible liner to the outer surface of a pre-cast concrete walled container to be buried in an earthen excavation.

13 Claims, 12 Drawing Sheets

DIAGRAM 1

DIAGRAM 2

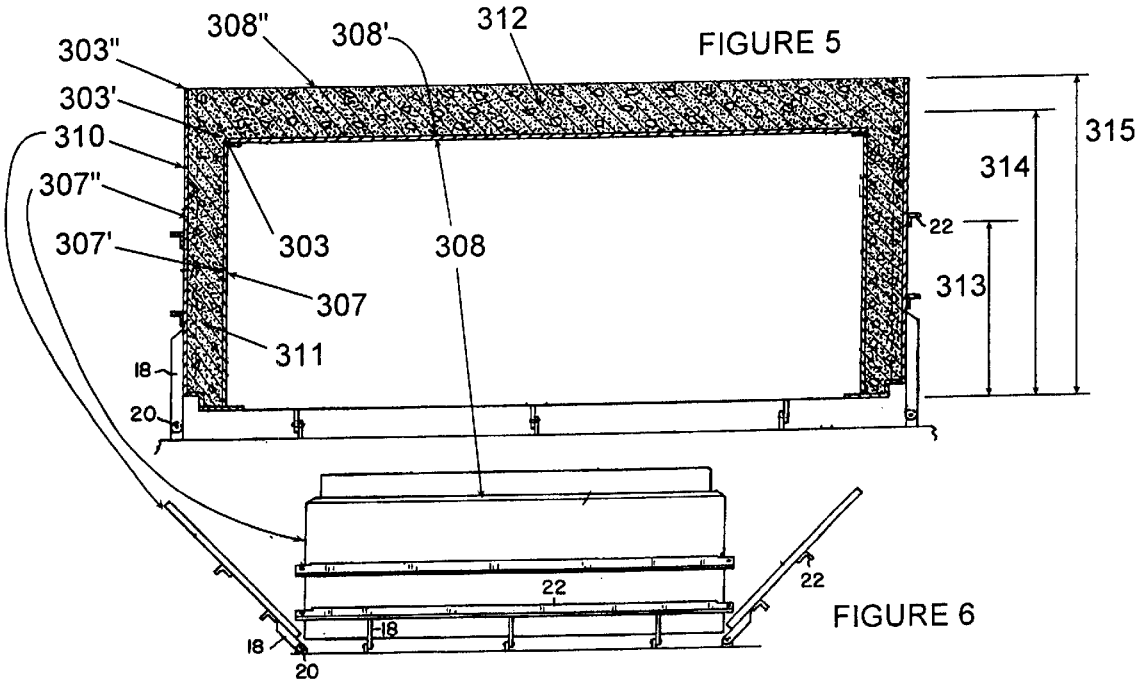
FIGURE 5
FIGURE 6
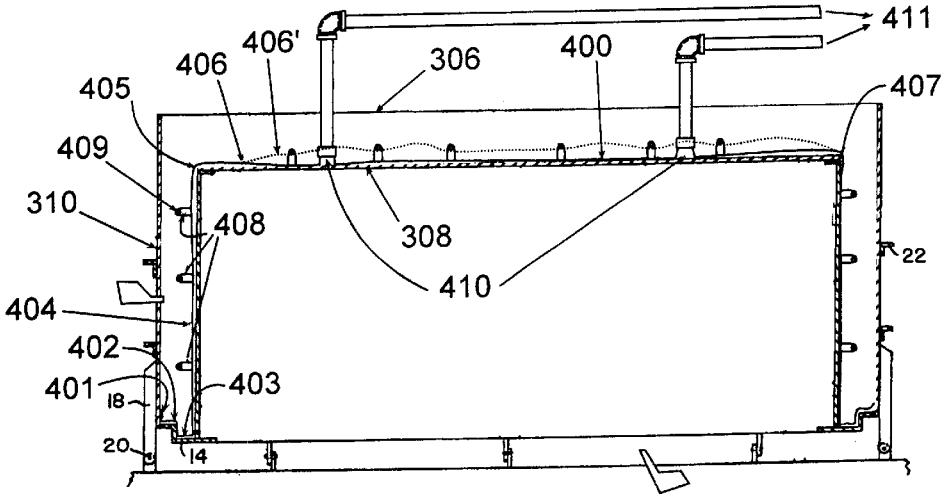
FIGURE 7

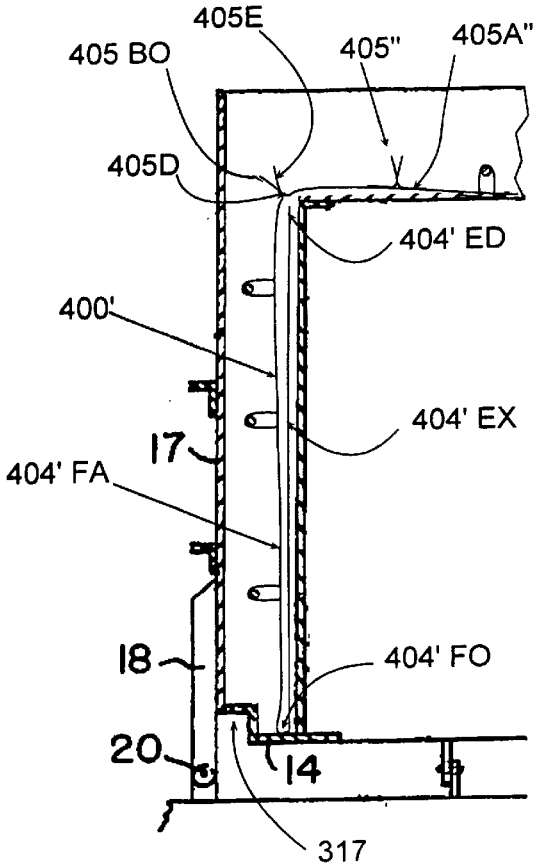
FIGURE 7A
FIGURE 7B
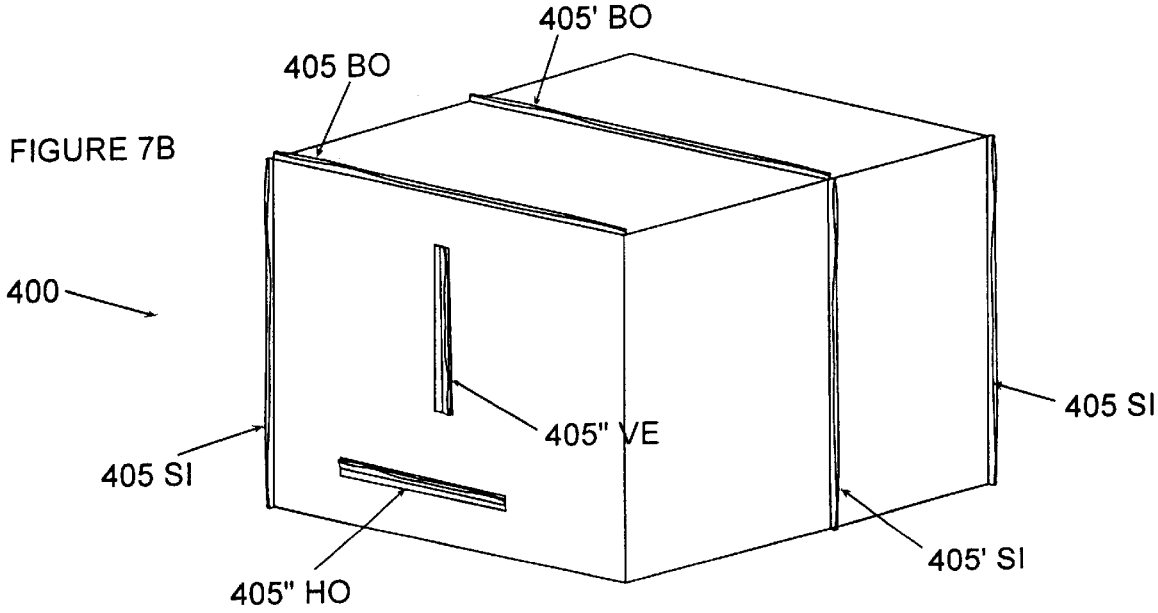

FIGURE 13
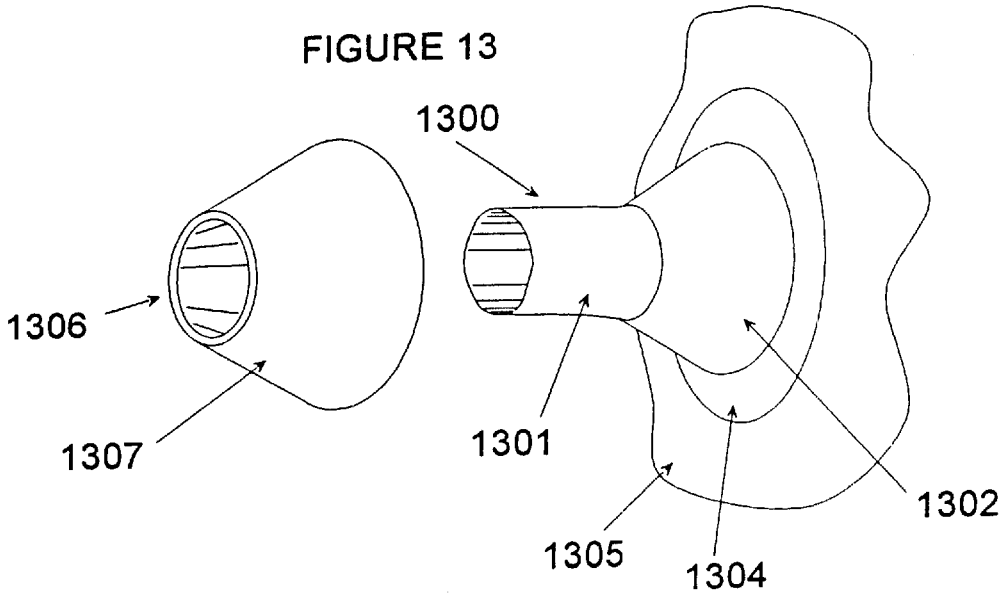
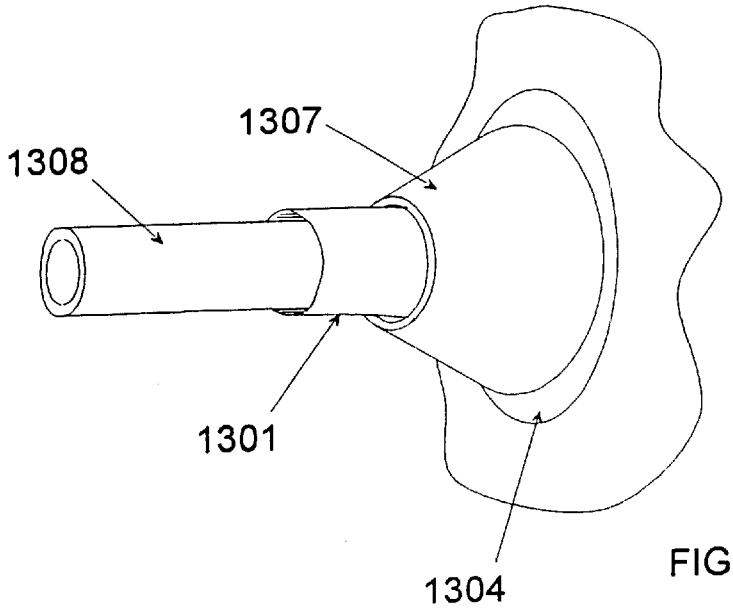
FIGURE 14

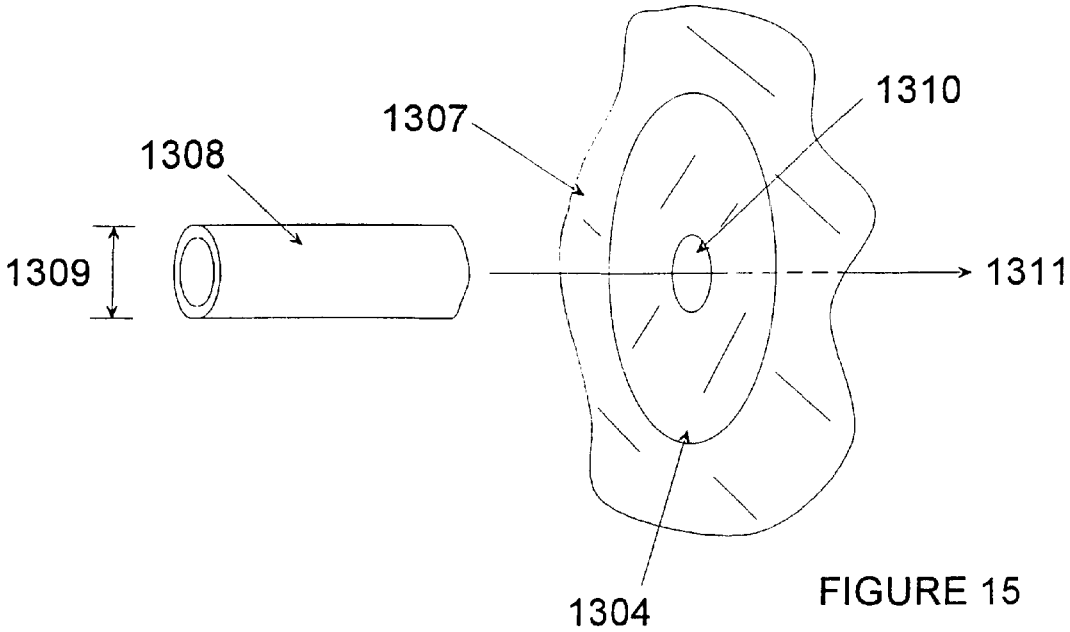
FIGURE 15
FIGURE 16
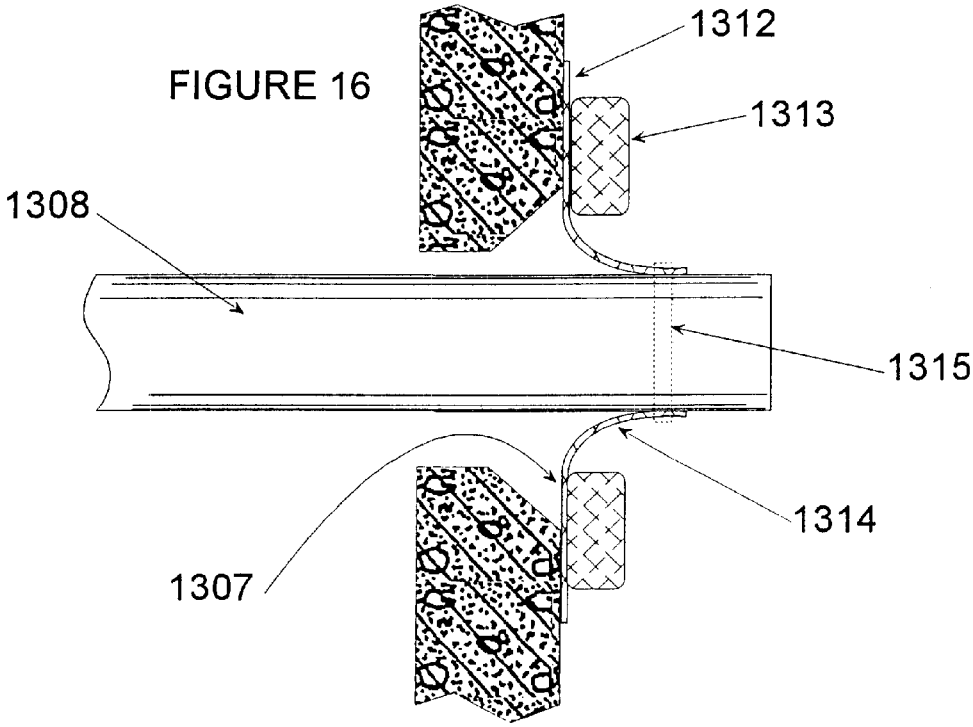

FIGURE 17
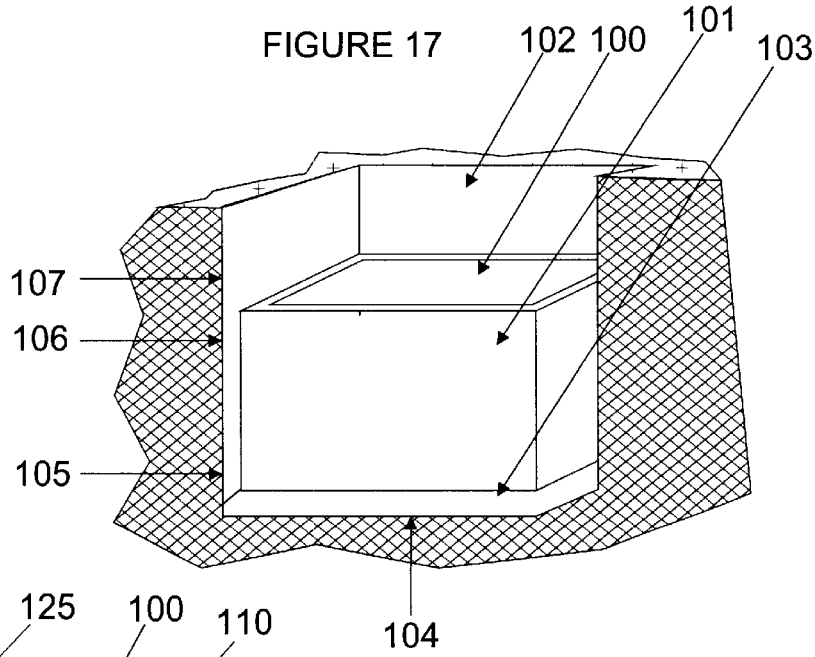
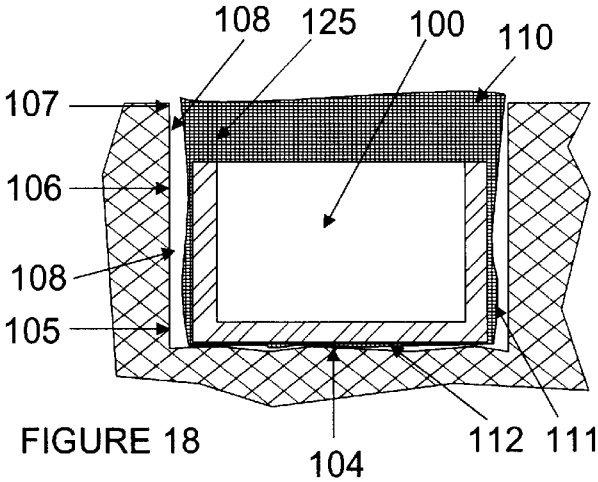
FIGURE 18
FIGURE 19
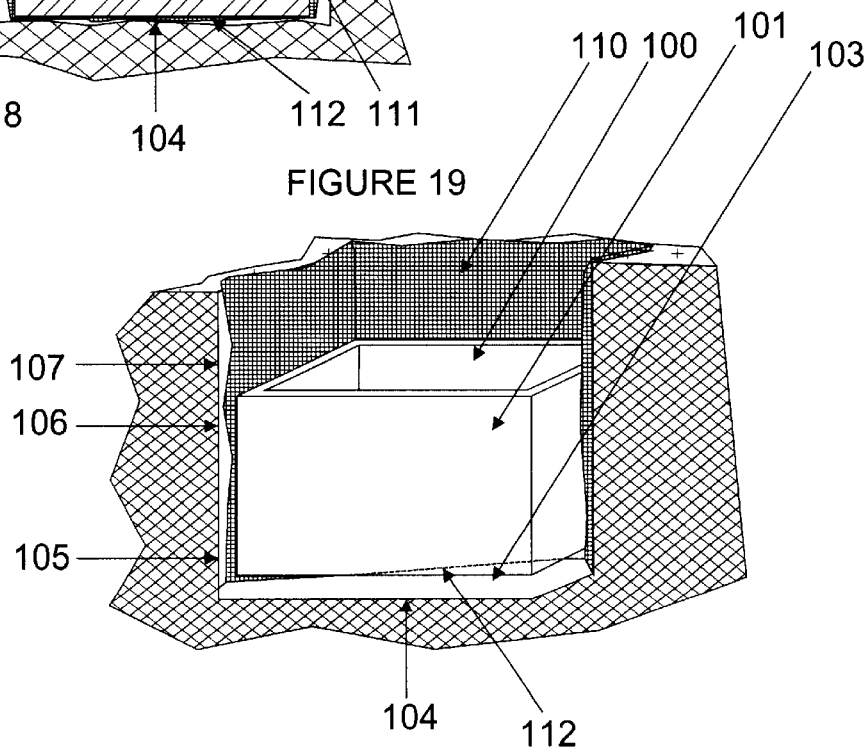

FLEXIBLE LINER FOR A CONCRETE CONTAINER

This application is a continuation in part of Ser. No. 09/347090 filed Jul. 2, 1999 now U.S. Pat. No. 6,202,370.

BACKGROUND OF THE INVENTION

The present invention relates to flexible liners for septic tanks, especially in a retrofit application. It is an object of the present invention to provide apparatus designed to facilitate the production of hollow cast articles such as septic tanks and concrete vaults, to facilitate separation between a carting and the forms used in making the casting, and to expedite the entire casting operation.

The prior art is filled with references to flexible tank liners and adaptations to fill and drain conduits, as well as upper and side support devices for the sidewalls. One example of a drain tank liner is shown in U.S. Pat. No. 5,656,766. A flexible liner forms a gas tight seal about the walls of an underground concrete vault. A concrete lid pressing on a circumferential flap at the top rectangular edge of the flexible liner provides support for the liner, such that the liner does not "slump" into the concrete vault and allow liquid to fill a space between the inner concrete wall and to outer surface of the flexible liner. It is especially important to note that the art in this patent recognizes that some adaptation is important for existing inlet pipes entering the concrete vault at a sidewall. A gasketed set of bolted plates seals the transition of a pipe entering the concrete vessel and passing into the flexible liner. The relatively heavy construction is the result of the impermissibility of leakage from the inside of the liner into the space between the liner and the concrete wall.

U.S. Pat. No. 5,656,766 thus illustrates several advantages and problems of flexible tank liners. Support and sidewall inlet pipe transitions are shown adapted to the special application of that patent, i.e., drainage pits primarily for the petroleum industry. An adaptation combining support and pipe/liner transition is seen in U.S. Pat. No. 4,653,663, wherein a rigid plate supporting the outside surface of the flexible is combined in opposition with an elastomeric plate on the inside surface of that liner.

Although not used to line storage tanks, the flexible liner of U.S. Pat. No. 4,388,357 shows that strips of liner stock can be fabricated on site to form a protective barrier against soil contamination by spilled oil, such as occurs at railroad tank car accidents in remote areas. The bottom of the fabricated flexible liner comprises a fabric screened drain so that the oil can be recovered for commercial use when the oil is withdrawn from the flexible liner. It would be especially useful to adapt flexible tank liner devices so that they could be used in situ, whereby none or relatively little of liquid in an existing storage tank would need to be removed. This is generally not practical in the art of lining tanks with flexible liners, i.e., the liquid is usually leaking into the environment outside of the tank or is further corroding the tank and destroying the support provided by the rigid tank walls.

U.S. Pat. No. 2,807,071 describes, and such description is incorporated herein, a casting apparatus comprising an inner form, a cover plate resting upon the inner form with respect to which file upper edges of the inner form are slidable, and means secured to the cover plate providing for limited upward movement thereof to facilitate separation between the cover plate and a completed-casting, with special application to casket vaults and extendible vaults, such extension being provided by stacking of a second or higher section above the base device described in that patent. The stacked piece is adapted to securingly mate with the piece beneath it, i.e., the cast article of U.S. Pat. No. 2,807,071 when formed comprises an upper inset rim which will accommodate a stacked section above it.

U.S. Pat. No. 3,990,673 describes the apparatus and method for casting concrete septic tanks, burial vaults and the like including an inner form and an outer form. The formation of concrete septic tanks burial vaults and other such structures generally contemplates the casting thereof in a "form". The form usually comprises an inner form and an outer form spaced apart from the inner form and into which the casting material, e.g. concrete, is poured. The outer form is usually a disassembleable rigid structure. The inner form comprises a rigid or expandable and collapsible side walls and end walls. The inner form also includes a top wall or cover plate which mates with the edges of the walls. The method of forming the cast article is basically providing a hollow inner form over which to pour concrete while also providing an outer form to force the concrete to be maintained against the inner form until the concrete hardens and the forms can be removed. The construction of concrete burial vaults is a very time consuming and labor intensive operation. The operation generally consisting of first constructing an inner form having a side wall and. bottom wall configuration identical to the interior surfaces of the side wall and bottom wall of the vault to be formed. The inner form is then mounted a pallet or other flat base surface with the bottom wall of the inner form positioned for upwardly. An outer form consisting of four side walls having a configuration identical to the outer side wall configuration of a vault to be formed was assembled, i.e., typically pivotally hinged at a lower edge of the outer form, around the inner form. The form surfaces in contact with the concrete are next oiled. It is next conventional to suspend a wire mesh, "rebar" (reinforcing steel rods) or the like into the cavity formed by the inner form and the outer form to provide additional strength to concrete poured into the cavity. The form cavity is next filled with concrete and vibrated to remove voids and to fill the lower sections of the form cavity.

U.S. Pat. Nos. 5,126,095 and 4,934,122 describe a cement

SUMMARY OF THE INVENTION

The present invention comprises devices and methods for supplying a flexible liner for septic tanks and for retrofitting existing, leaking septic tanks with such flexible liners.

Metal septic tanks are usually welded along an seam formed from the intersection of an axially symmetrical plane with the cylindrical or rectangular shell. Thus, the weld runs down the side of the septic tank, along the bottom of the tank and up its opposite side. It is an almost universal fault the septic tanks leak along this seam within their "useful" lives, that is, useful in terms of support, not containment. Although in the past such leakage was generally permissible, current regulation, especially among the rural districts of the eastern states of the United States, undigested sewage leaking into the ground immediately next to the septic tank accelerates the rate of corrosion of the tank and unacceptably contaminates the ground water with material having biological oxygen demand that facilities bacterial blooms. The design of septic tanks requires that the sewage remain in the tank for a treatment period so that the BOD and COD is reduced to an acceptable level. Metal septic tank replacement is wasteful since much of the support function of the septic tank is still available, although unacceptable leakage may have occurred.

Some septic tanks have concrete side walls and floors. Liquid sewage containment with concrete makes it certain that crack and fissure propagation via earth shifting and chemical attack will eventually result in unacceptable leakage as for the metal septic tanks. Repair is typically the only reasonable solution, although repair materials are sometimes as hazardous as the leaking sewage. Various patching materials are identified under federal regulations as hazardous if released into the groundwater. The eventual further cracking of the concrete septic tanks mean that both untreated sewage and the patching material may escape later on into the ground water.

One embodiment of the present invention comprises a flexible polymer liner of relatively heavy gauge polyurethane, vinyl, fiber-reinforced polyethylene, ultrahigh molecular weight polyethylene, or the like or layered composites thereof with relatively few rf-welded seams. Preferably, a single, uninterrupted sheet of flexible lining material forms a floor cover, being then sealingly connected to one or more sidewall sheets. The sidewall sheets preferably extend in a single sheet from the top of the septic tank to the floor sheet, thereby having vertical seams. Vertical seams are less subject to separation from the downward pull of gravity than similar horizontal seams. The lining body of the flexible liner thus "effectively" seals a polygonal or round vertical in-ground septic tank against leakage. It will be appreciated that absolute prevention of leakage of untreated is preferred but not completely unacceptable. In other tank lining applications with flexible liners, the object of the device is complete sealing of the liquid within the vessel. For septic tanks, some small amount of leakage could be acceptable. Thus, crack propagation in concrete or metal septic tanks means that every leak must be repaired or it will get worse. With the flexible liner of the present invention, a seam leak is unlikely to become larger due to corrosion. A seam leak will likely remain small since little liquid motion is experienced by the flexible liner. Thus, the requirements for fabrication of the lining body and inlet and outlet pipe/liner connections are surprisingly less stringent than those of prior art flexible liners.

Most septic tanks are concrete, although some are currently made with at least fiberglass floors and sidewalls. Patching a leak in a fiberglass septic tank can be challenging. The location of the crack and/or fracture or fiber separation area may be difficult to make sufficiently clean or dry to patch with commonly available materials.

It is heretofore unknown that a retrofit of an existing septic tank could be accomplished for such low cost with a flexible liner. It has been unappreciated that, for design purposes, the septic tank remains full all the time with almost unmeasurable liquid flow movement against the sidewalls or floor. The design requirements are thus dramatically reduced with consideration of that freedom from absolute sealing, turbulence or liquid level changes.

A lining body may be used for sidewall sealing with a relatively rigid or reinforced flexible material and still comprise low cost polymer material. Such support is an alternate embodiment to enhance the ease of initial installation and later drainage.

Another embodiment of the present invention comprises a collar at the top edge of the lining body with flotation means circumferentially and sealingly attached to that top edge. In one form, the lining body flexible material is extended upward, over and around inexpensive flotation material such as styrofoam, thereafter sealing the top edge of the flexible material to an inner or outer surface of the lining body to form a collar pocket. This collar pocket contains sufficient flotation material to keep the upper most surface of the lining body above the liquid (and preferably foam) level in the septic tank. The problem of support of the lining body is thus solved without attachment to the septic tank support (i.e., the concrete or metal shell). With little or no variation in liquid level and little liquid turbulence, the flotation collar pocket material is not subject to abrasion against the inside walls of the septic tank support, thus maintaining an effective air pocket which may alone act as flotation means for the lining body.

It is another embodiment of the present invention to provide inlet and outlet pipe/liner transition taking advantage again of the small change in liquid level and low liquid turbulence. In its simplest form, the lining body may have cut into it an "X" or "Y" opening, whereby the inlet and outlet "T" pipes may pass through and be "effectively" sealed against unacceptable levels of leakage with a simple metal or plastic band or collar. It is anticipated that this seal would have to withstand no more than about 1–2 psig of pressure with little liquid level change or liquid turbulence. Although the prior art teaches relatively heavy duty devices to accomplish this inlet and outlet pipe/liner transition, those prior art devices are directed to non-quiescent tanks. It is an inventive step to have realized that a much less expensive flexible liner could be made and installed than those of the prior art.

With enabling reference to U.S. Pat. No. 4,388,357, it will be seen that perfect sealing against the environment may not be necessary or economic. Similarly, the present invention also comprises installing a retrofit of one of the embodiments of the flexible liner above into an existing septic tank. Typically, septic tank repair requires complete evacuation and cleaning of the septic tank support structure, i.e., with compressed water spraying and additional evacuation. Cleaning of the septic tank will not be absolutely necessary with installation of the present flexible liner. The corrosion that caused leakage in the original concrete or metal shell rarely affects the structural support of the shell against the earth surrounding it. In fact, sometimes removing the corrosion products from that shell by water spraying may weaken the compressed earth/shell structure so that the shell must be replaced.

In yet another retrofit application, it will be possible to effectively tightly fold and compress the lining body of the flexible liner into a small package which can be submerged into a filled or partially evacuated septic tank. The lining body may be equipped in inflation cuffs, tubes or pockets that, upon inflation by an air pump above ground, will flow the appropriate portions of the lining body into relatively close association with the floor and sidewalls, thereafter moving to the liquid surface the upper edge of the lining body for securing at the top edge of the septic tank shell and adaptation for insertion of the inlet and outlet pipes. The sewage remaining between the flexible liner and the septic tank shell comprises a measurable but acceptable corrosion risk against the structural support shell supporting the flexible liner. Other means of drawing a folded lining body against the appropriate sections of the septic tank shell include using rigid manipulation poles or the like to grasp and position the lining body next to the sidewalls of a full or partially filled septic tank.

In yet another installation method, the flexible liner may be placed on the floor of an evacuated septic tank, the main portion of the flexible liner arranged so that it is loosely arranged about a deflated inflatable and flexible balloon enclosure. This balloon enclosure will have an inflated volume and shape of about the same as or slightly larger than that of the evacuated septic tank. When the balloon enclosure is inflated, the flexible liner is also expanded across the floor and toward the sidewalls of the septic tank. The flexible liner is loosely secured around the balloon enclosure so that the top edge of the flexible liner is forced slowly upward to the top edge of the septic tank sidewall, eliminating manual spreading and lifting in installation of the flexible liner. Loose temporary securing means for the flexible liner about the balloon enclosure comprise elastic straps or ties that can be easily removed as installation aids.

The present invention is applicable to the septic tank type known as "tight" tanks, which are not permitted any leaching emission, but must be evacuated periodically to remove accumulated sewage. The sort of evacuation means available in the above cited prior art may be applied to as evacuation means for the present invention.

The lining body of the flexible liner may be enclosed by forming a sealing seam between a top closure piece and the top edge of the lining body. The top closure piece is preferably not gas tight to the environment, since some gas generation is typical of sewage digestion. However, a continuous "zip-loc" or other similar closure for the top closure piece may be used to achieve gas tight closure if such gaseous emissions are a nuisance. A discharge pipe is preferably sealingly attached to the gas-tight top closure piece to conduct away nuisance or hazardous gases for passage through effective cleaning means such as an activated carbon bed or regenerable zeolite bed.

It is a further embodiment of the present invention to provide apparatus and a method for applying a flexible and inexpensive liner to the inside surface of a concrete vault in the concrete casting operation of such a septic tank, casket vault, electrical component containment vault or other concrete vault whereby sufficient liner adhesion and/or attachment to the inside walls of the concrete vault is achieved such that a liquid impermeable seal is provided and the flexible liner will remain effectively attached to the inside wall of the concrete vault during normal usage of the concrete vault. Clearly, the several uses of concrete vaults will instruct the skilled person to choose among the several methods of securing adhesion and/or attachment of the liner described herein. Some of the apparatus and methods described below comprise mainly adhesion of the drying concrete to the smooth or preferably embossed flexible liner while a non-removable liner is obtained with extension of the liner by seam extension or extension attachment into the wet concrete and permitting the concrete to dry about the extension. It is well known that very stiff plastic lugs secured to a stiff plastic base plate will be effectively projected into wet concrete for drying securement therein if sufficient force is maintained to keep the lugs in the wet concrete. It is novel that flexible liner material attached to a flexible base material will be effectively projected into wet concrete for drying securement therein.

BRIEF DESCRIPTION OF THE DRAWINGS

Diagram 1 is a cutaway side view of a septic tank with a detail drawing of an inlet or outlet "T" pipe adapted with a sealing transition to the rigid liner of the present invention having clip support attachments at the upper edge.

Diagram 2 is a partially cutaway side view of the flexible liner of the present invention showing a flotation collar as substantially the sole support for the flexible liner, in conjunction with the liquid fill.

FIG. 5 is a generalized cross-section view of a device shown in FIG. 4 with the side walls held in a forming position and concrete filling the form cavity to form a concrete vault. No liner is provided in this prior art assembly.

FIG. 6 is substantially the assembly of FIG. 5 with the four side walls opened for removal of the concrete vault.

FIG. 7 shows the liner of the present invention for the generalized assembly of FIGS. 3–6 with optional trapped air removal means and optional rebar loop securement means for a single level concrete vault, as compared with a multi-section, stacked concrete vault.

FIG. 7A is an expanded cut-away view of the assembly of FIG. 7 with other embodiments of the liner of the present invention, especially an inwardly folded extension of the liner for a multi-section, stacked concrete vault and extended seam or applied extension strips for securement into the wet concrete poured into the form cavity.

FIG. 7B is a perspective generalized view of the liner of the present invention with certain extension embodiments incorporated at the inner form edges and flat sections.

FIG. 13 shows the known frustro-conical insert for precast concrete septic tank in relation to a liner adaptation of the present invention providing a liquid tight seal to the inlet or outlet pipe of the septic tank.

FIG. 14 shows an associated and assembled aspect of the frustro-conical insert and the liner adaptation of FIG. 13 with an inlet or outlet pipe passing therethrough.

FIGS. 15 and 16 show an alternate method of forming a pipe to liner seal.

FIG. 17 is a cutaway perspective view of a cement container in an excavation.

FIGS. 18 and 19 are respectively cutaway side and cutaway perspective views of a cement container surrounded with a liner in an excavation.

DETAILED DESCRIPTION OF THE INVENTION

The invention is now discussed with reference to the Diagrams. It is seen in Diagram 1 that an existing concrete tank is enclosed on its inner surface with a rigid liner, as described above. In the detail drawing, it will be seen that a series of plastic clips along the upper edge of the rigid liner holds it in place. The plastic clips are exemplary of a class of securing devices such as bolting plates, and the like, although the buoyant effect of the relatively constant liquid fill of a septic tank reduces the ultimate design requirements of that securing means. Also in the detail drawing of Diagram 1, it will be seen that an "X" incision has been made in the liner to permit passage of the inlet or outlet "T" pipe through it. A simple and inexpensive plastic or metal adjustable band is preferred to seal the liner to the pipe circumference.

With reference to Diagram 2, it will be seen that the liquid fill of the septic tank compresses the liner against the floor and sidewalls of the existing concrete structure. It is apparent from common design of septic tank depth that the highest pressure against the liner is at the bottom of the septic tank, i.e., about 9 psig. With a quiescent tank of liquid the design and fabrication of the flexible liner is greatly reduced in price.

Also in Diagram 2, the flotation collar comprises a simple overlap of flexible material from the lining body, such that the gas-tight enclosure may be inflatable or comprise additional flotation material such as inexpensive styrofoam. The use of styrofoam may eliminate the need for a gas-tight enclosure, such that only broad loops or separate pockets flotation material are needed at short intervals all along the upper edge. It will be clear from this disclosure that the flotation collar may be combined with the top edge securing means of Diagram 1 to obtain an advantage in installation or cost.

The above design disclosures present the skilled person with considerable and wide ranges from which to choose appropriate obvious modifications for the above examples. However, the objects of the present invention will still be obtained by the skilled person applying such design disclosures in an appropriate manner.

Figure 3:
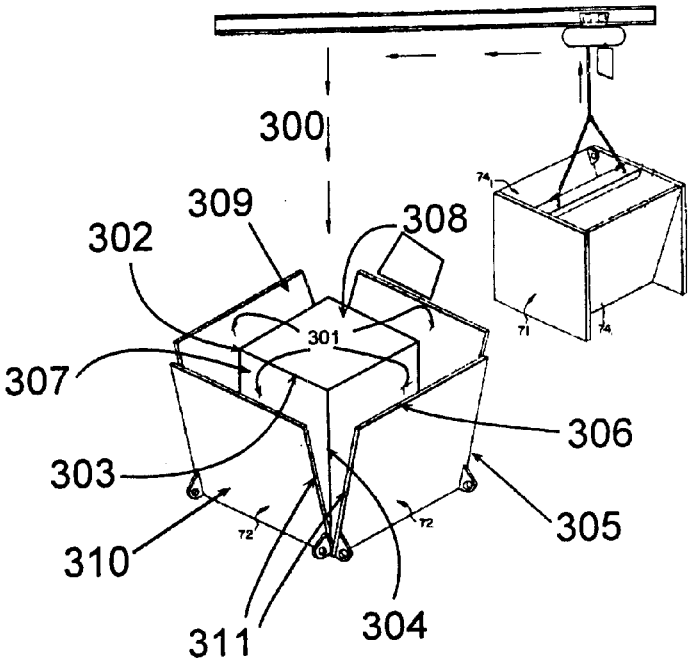
FIG. 3 is a perspective view of a generalized inner form and an outer form comprising four side walls pivotally hinged near their bottom edges for forming a cast concrete vault, the liquefied concrete to be provided from a suspended container.

The invention is now discussed with reference to FIGS. 3–12 and the application of a flexible liner at the casting operation of a concrete vault. A typical casting operation is now described for reference for application thereto of the flexible liner of the present invention. The apparatus illustrated in FIG. 3 shows a suspended flowable concrete volume in container 71 with releaseable walls 74, which flowable concrete is to be released in direction 300 to flow over inner form top outer surface 308 in directions 301 to fill the form cavity, i.e., only after side walls 72 are brought into a secured upright position to contain the flowing concrete. The inner and outer forms are described for reference for later location of the flexible liner of the present invention relative to them during a casting operation.

Figure 4:
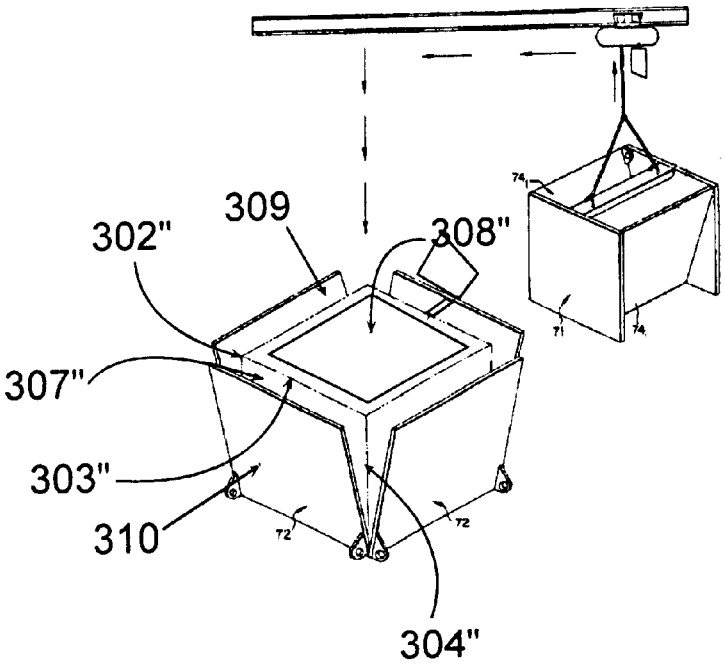
FIG. 4 is a view similar to FIG. 3 with a hardened concrete vault in place over the inner form and with the four side walls opened for removal of the vault.

Top corner 302 is formed by the meeting of top edges 303 and side edge 304. Side walls 72 have a height 305 and width 306 and an outer surface 310 and inner surface 309, the mating of edges 311 in the upright position causing the formation of an outer side edge of the concrete vault. FIG. 4 shows the result of forming a concrete vault on the inner form and pivotally opening the side walls 72 for removal of the vault after the concrete is sufficiently set to remove it. Vault top outer surface 308" forms what will be the bottom of the vault when the vault is inverted for use. Top vault corner 302" generally corresponds to the meeting of top outer vault edges 303" and side outer edges 304".

FIG. 5 generally shows a cross section of the assembly of FIG. 4 with some adaptations to form a stackable vault base, i.e., the molded multi-level rim 317 as shown in FIG. 7A and the rectangular form more generally associated with burial vaults. Form edge 303 mates with inner vault edge 303', whereby the concrete vault extends to outer vault edge 303". Inner form side 307 is adjacent to inner vault side 307', whereby the concrete vault extends to outer vault side 307", which is adjacent to the inner side of the outer form side wall 309. Inner form top 308 is adjacent to inner vault top 308', whereby the concrete vault extends to outer vault top 308". Side wall concrete 311 is continuous with top section concrete 312. Pivot 20 provides hinging to support 18 so that the side walls may be opened outwardly for removal of the vault, as shown in FIG. 6. Support 22 is generally an angle iron reinforcement for the side walls.

It is intended that a flexible liner be applied to the inner form before pouring of the concrete into the form cavity such that the liner sealingly covers at least all of top 308' and is continuous downward (with reference to FIG. 5) from edge 303' to a desired effective distance all about the circumference of side 307' to form a liquid tight seal between the bottom section of a concrete vault and the liquid to be held within in it or to be restricted from entering it. Liner materials comprise those typically used in waterbed construction, for pool or pond liners and the like, but especially favored are the non-reinforced vinyls with acid and chloride resistance with about 30 mil thickness. It is a critical requirement that liner material be flexible and foldable under conditions of application to the inner form of the concrete vault mold. The prior art has failed to appreciate that application of a flexible liner may be made to an inner form of the devices shown in FIGS. 3–7 causing effective securement to the inner side thereof. It is well known that an essential step in casting of vaults is the substantial vibrating of the inner and outer forms to remove voids and trapped air. It appears that the skilled person has been led away from using a flexible liner on the inner form during the casting operation for fear of tears and insufficient adhesion or attachment.

The present invention describes actual examples wherein the liner has been successfully installed on relatively large septic tank molds, obtaining thereby adhesion and attachment by the construction and method of application. The invention is now described in more specific detail with reference to FIG. 7. Liner 400 extends from an edge 401 to rim sections 402 and 403, and therefrom to sidewall section 404, edge 405, top section 406, edge 407 and downward along the side of the inner form duplicating the other edge 401 to rim sections 401 and 402, and therefrom to sidewall section 404. It should be understood from this FIG. 7 that this embodiment of the liner is sealingly continuous from one edge to another, forming a liquid tight barrier between the inner form and the concrete to be poured into the form cavity. In the form cavity are seen radial cross sections of rebar 409, which are suspended within the form cavity to provide reinforcement to the concrete vault after the concrete has hardened. In one optional embodiment of the present invention, rebar loop securements 408 are RF welded, heat sealed or otherwise adhered to the surface of liner 400 in appropriate locations such that when the rebar is inserted in the form cavity, the rebar is also passed through the securements 408.

In another embodiment of the present invention, threaded hose connections 410 are provided in surface 406 and adapted such that a vacuum adapted hoses or pipes 411 are connected to the connections 410 to remove air trapped between liner 400 and the inner form. Such threaded hose connections are well known in the waterbed industry.

Figure 1:
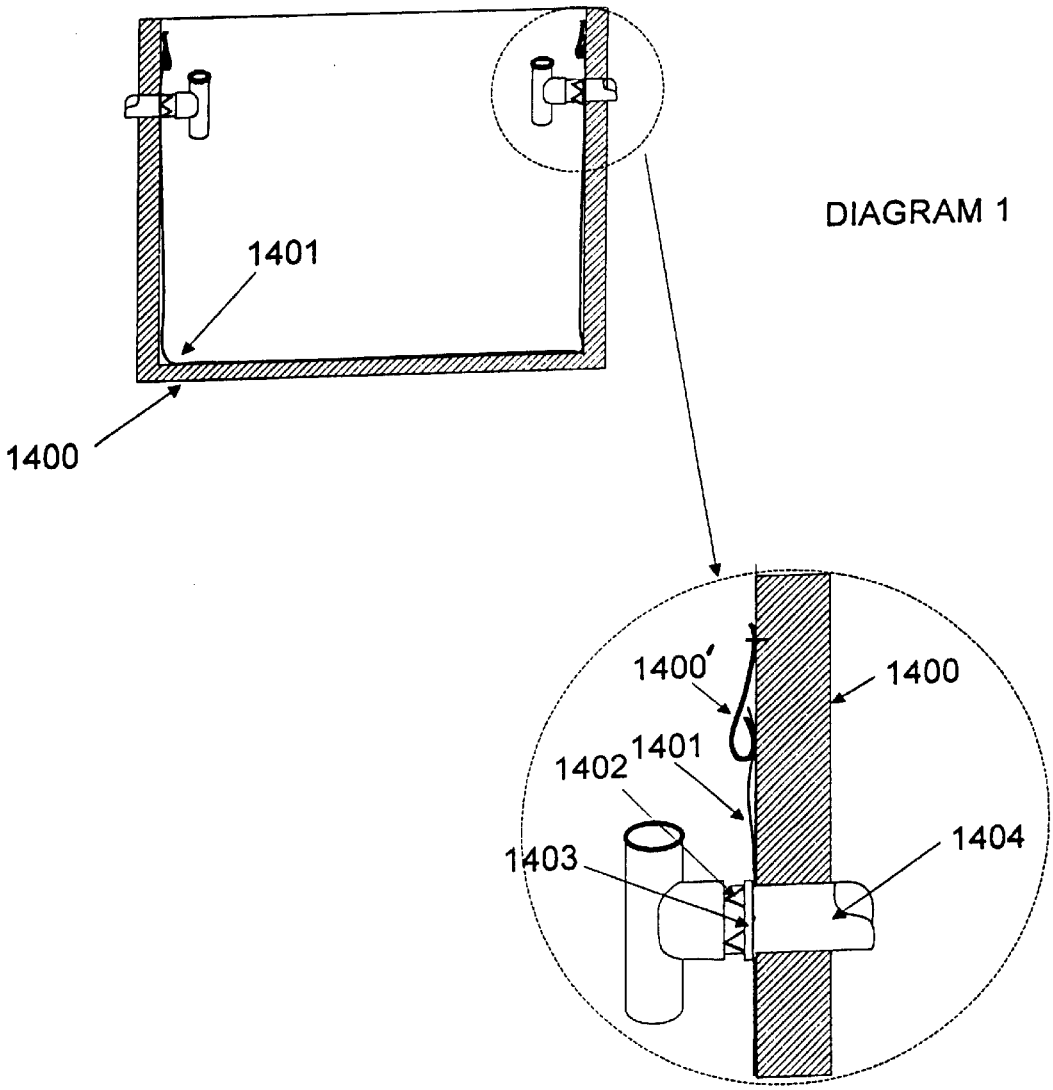
Figure 2:
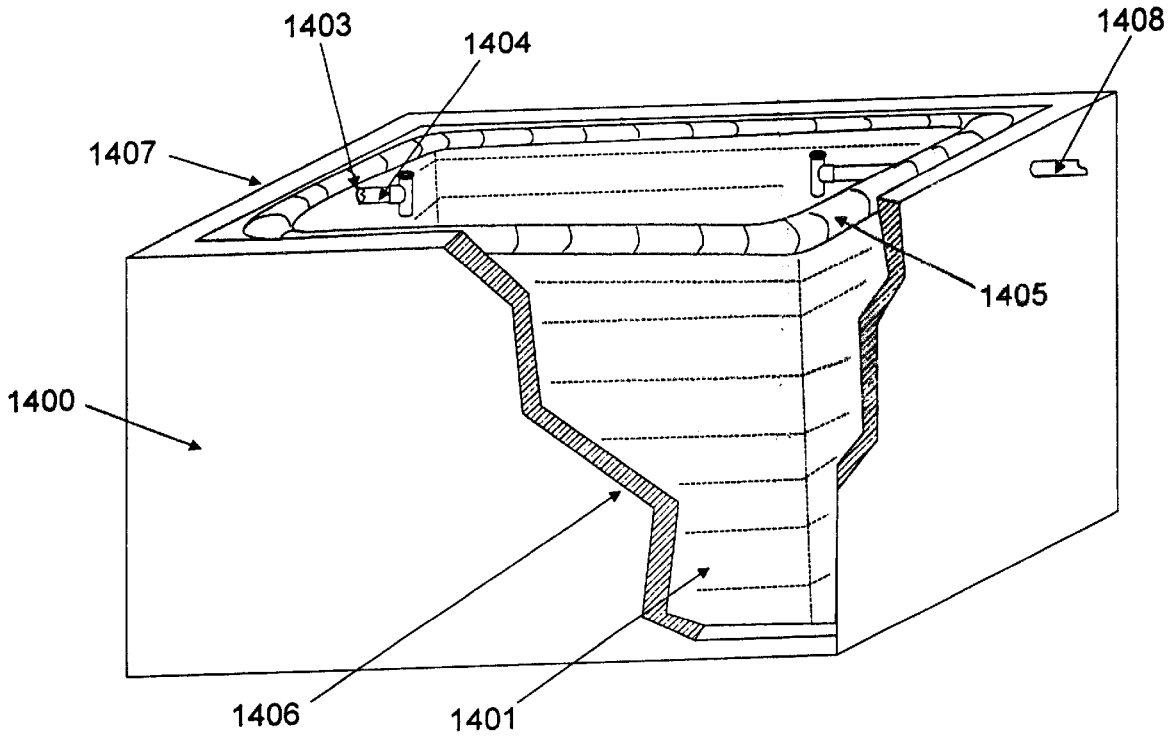

The method of forming a concrete vault with the embodiment of FIG. 7 is now discussed. Reference is made to the three concrete fill levels 313–315 in FIG. 5 and directions 301 in FIG. 1, which are important to the just mentioned method. When concrete is flowed over the surface of the liner covering top 308 in FIG. 7, the concrete flows in directions 301 to the side form cavities and begins to fill the side form cavities to level 313. At that point, an effective air tight seal is made around the bottom periphery of the side form cavities. Thus, as concrete fills from level 313 to 314, substantial air typically accumulates between top 308 and the inside surface of the liner 400, causing the surface 406 to take on the cross section appearance shown in lifted surface 406'. The means for removal of the trapped air are usually needed even if concrete is filled to level 315, as the weight of the concrete on the flexible surface is insufficient to push the trapped air out. Connections 410 and pipes 411 permit removal of the trapped air, whereby thereafter the connections 410 are disconnected from pipes 411 and capped in a conventional liquid sealing manner. Alternatively, the surface 308 may be simple provided with holes therethrough to allow escape of the trapped air or vacuum-assisted draw conduits may be established to more forcibly remove trapped air from underneath the flowed concrete instead of from above, as shown in FIG. 7. During the concrete filling operation, concrete easily fills the securements 408 an irremovably secures the liner to the side and bottom walls of the vault upon hardening of the concrete. Such filling later described in more detail with reference to the Figures.

Upon sufficient curing of the filled concrete, the side walls are opened and the vault removed, which removal is now more easily achieved since the liner surface slips smoothly from the oiled metal surface more easily than the dried concrete as in the prior art.

With reference to FIG. 7A, other embodiments of the present invention are described. As described above, concrete vaults may be increased in height with application of stacked sections. The embodiment of FIG. 7A provides a means and method for applying the liner 400' to the full height of the stackable concrete vaults. The surface 404' FACE extends from an edge 405 to a lowest edge 404' FOLD, at which point the liner continues sealingly to another section 404' EXTENSION to the edge 404' EDGE. The cross section shown in FIG. 7A is indicative of rest of the liner periphery about the inner form. Upon removal of the vault from the inner form and subsequent stacking of the next vault section upon rim 317, the section 404' EXTENSION is unfolded upwardly and secured as described above for retrofit application to provide a liquid tight seal for the entire inner surface of the stacked vault.

Additionally, in FIG. 7A are shown a seam extension 405 BOTTOM with separate material section extensions 405E, extending upward from the sealing seam 405D, which sealing may be preferably achieved with RF welding, but may also be produced with heat or adhesive sealing in some applications. The following description of the Figures further develops the concept and application of extensions to the outer surface of liner 400 to extend into the flowed concrete during the casting operation to achieve effective securement of the liner to the inner side and bottom walls of the vault.

Figure 8:
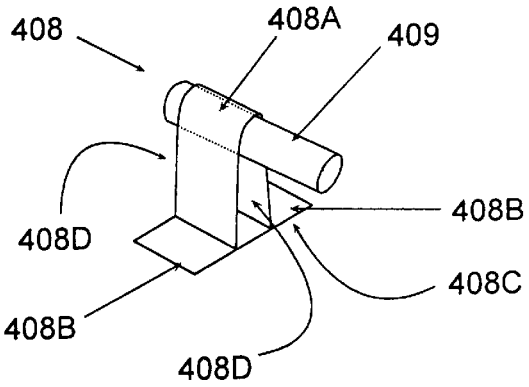
FIG. 8 is a detailed perspective view of the rebar loop securement shown in FIGS. 7 and 7A.

FIG. 8 shows rebar loop securement 408 with a section of rebar 409, loop 408A and base piece 408B, which is preferably RF welded or otherwise adhered to the outer surface of liner 400 in a location which, when the liner is applied to the inner form, will accommodate passage of the rebar through it in the normal course of setting the rebar in place for the casting operation. During the casting operation, concrete flows into the loop 408A in directions 408C, the concrete remaining therein during hardening and providing a non-removable attachment of the liner 400 to the inner surface of the vault.

Figure 8A:
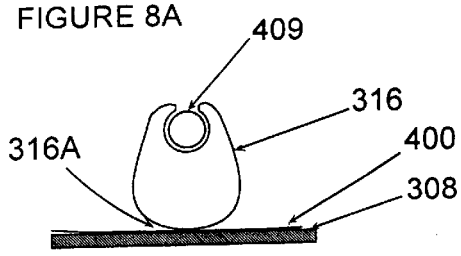
FIG. 8A is an end view of an assembly incorporating a spacer to hold the rebar away from the liner of the present invention as shown in FIG. 8.

FIG. 8A shows a preferable but optional support piece 316 for rebar 409. Piece 316 in a specific example was adapted to hold the rebar about 1.5 inches from top 308, providing a rounded surface 316A to contact liner 400. Piece 316 comprised a low cost rigid plastic piece about 3 inches in height with a snap-in top section for rebar, the thickness of piece 316 being about 0.5 inches. Piece 316 applied near or between securements 408 force the rebar away from the inner form, drawing the securements 408 into the flowing concrete in the casting operation, whereby piece 316 becomes part of the cast vault, although its rounded contact with liner 400 provides only limited opportunity for later leaking through the cast passage if liner 400 fails.

Figure 9:
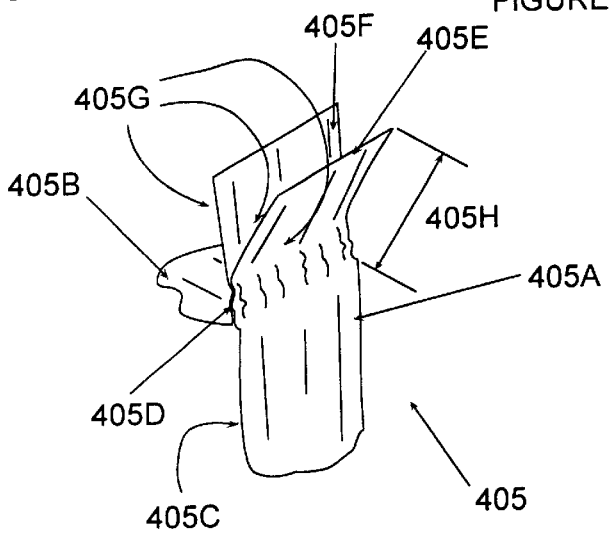
FIG. 9 is a perspective view of section of the liner of the present invention with a liner seam of the present invention adapted to be situated at the upper and side edges of the inner form, causing the flexible projections to be held sufficiently outward into the form cavity that concrete flowing into the form cavity will also flow sufficiently about the extensions to result in irremovable attachment of the flexible liner to the inside vault wall.
Figure 10:
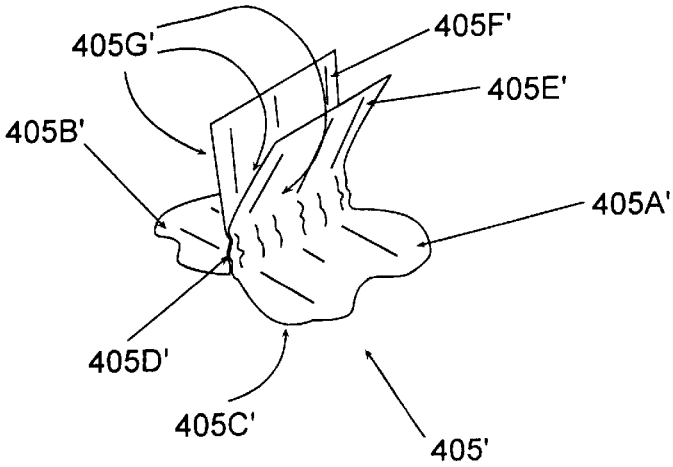
FIG. 10 is a perspective view of section of the liner of the present invention with a liner seam similar to that of FIG. 10 although adapted to result in securing extensions from a flat section of the inner form.
Figure 11:
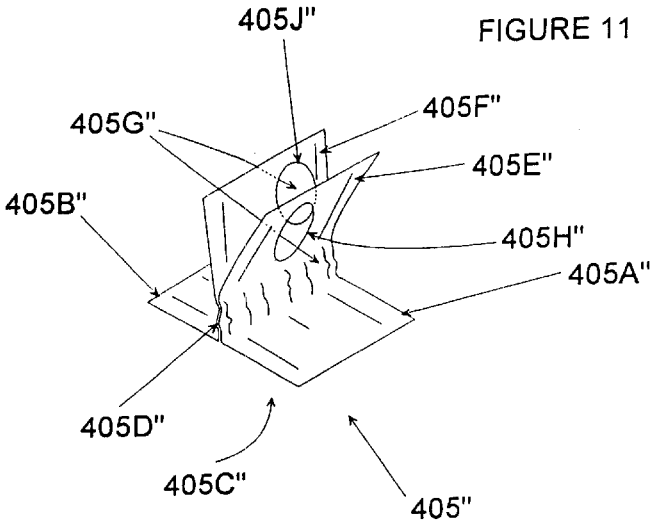
FIG. 11 is perspective view of section of an extension bearing strip adapted to be bonded to the liner of the present invention to form extensions with the effectiveness of those of FIGS. 9 and 10. Optional holes are shown to further improve the flow of concrete about and through the extensions, thereby achieving a substantially improved liner securement.

FIG. 9 presents an edge seam, such as for application to the top or side edges described above for the inner form. Providing extensions from the liner at these junctures provides an opportunity to use to stretching effect of the adjacent pieces of material to cause an extending presentation of excess material used in a seam wherein the inner faces of the adjacent pieces of material are joined, preferably by RF welding. In a specific example, adjacent materials 405A and 405B, about 30 mil vinyl sheets, have their inner surfaces (such as 405C) joined by RF welding at seam 405D, intentionally designing the fabrication process such that excess material extensions 405E and 405F, along with seam 405D material, results in a extension height 405H of the assembly. This extension height 405H will be effectively projected into the flowing concrete 405G, forming an irremovable attachment of the liner with the inner edge of the vault. Extension height 405H has been found to be effective for the objects of the present invention at over 2 inches with 30 mil vinyl sheeting which has been RF welded to form a liquid tight seal. FIGS. 10 and 11, liner extensions adapted to apply to the flat surfaces of the inner form instead of at the edges, show a similar embodiment of seam extension as that of FIG. 9 although the similarly named aspects are different in the following manner. Adjacent pieces 405A' and 405B' of FIG. 10 and adjacent pieces 405A" and 405B" of FIG. 11 extend generally in the same plane above an outer surface of the inner form. The effective extension height 405H is generally about the same as that of the assembly of FIG. 9. FIG. 11 is intended not to be a liner seam, but instead an effectively adherable strip which is independently applied at any outer surface of the liner, thereby providing freedom to form concrete-intrusible extensions at any point at which the flowably concrete contacts the liner applied to the inner form.

Figure 12:
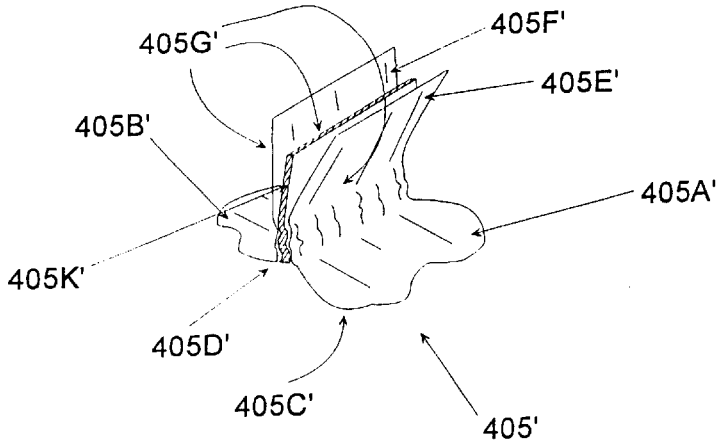
FIG. 12 shows substantially the liner seam of FIG. 10 although a stiffening strip is sealingly secured between the flexible liner material sections to provide improved concrete depth insertion of the extension of the liner resulting in improved liner securement.

The assembly of FIG. 11 comprises a further adaptation applicable to the seam extensions of FIGS. 9 and 10. Holes 405H" and 405J" are made in extensions 405E" and 405F" respectively, thereby permitting concrete flows 405G" therethrough. It has been found that this provision of offset or corresponding orientation holes in the material extensions produces an attachment with surprisingly superior strength over the same type of extensions without such holes. In another embodiment of the present invention as shown in FIG. 12, a reinforcing strip 405K' may be sealingly welded or bonded into seam 405D', thereby improving the attachment of the liner to the cast vault inner surface.

It has been found that a liner 400 without securements or extensions as described above may effectively attach to the inner surface of a cast vault in the method described above upon providing sufficient excess material such that the width and/or length of the liner is about over 0.5 inches greater than the respective width and/or length of the outer surface of the inner form to which the liner is applied. The excess width and/or length has surprisingly been compressed by the filling concrete and found to be drawn into a creased intrusion into the hardened concrete, forming an effective attachment of the liner to the inner vault surface. As little as ⅛th of an inch intrusion provides liner detachment resistance of about 10–15 pounds of force. Intrusions of over 0.25 inches occur that are very difficult to detach or are irremovable without tearing the liner. Embossment of the outer surface of the liner with some irregularities over a smooth surface will provide adhesion enhancement without other attachment means.

FIG. 7B shows a generalized liner 400 with seam and strip extensions applied to provide reference for advantageous placement therefor. Liner 400 of FIG. 7B appears as it would in place covering an inner form of a casting assembly. The flexible nature of the materials of construction are critical to ease of manufacture, transportation and application of the liner to the inner form. A rigid liner material loses all the above advantages. Extensions 405 SIDE form welded extensions that will extend into the inner side edges of the vault. Extension 405 BOTTOM forms welded extensions that will extend into the inner bottom edges of the vault. Extension 405' BOTTOM forms welded extensions that will extend into the inner flat bottom surface of the vault. Extension 405' SIDE forms welded extensions that will extend into the inner flat side surface of the vault. Extensions 405" HORIZONTAL and 405" VERTICAL form welded extensions that will extend into the inner flat side surface of the vault, although, as described above, such strips may be applied at any point on the outer surface of the liner.

As clearly shown in FIG. 7B, some or all the liner edges corresponding to the inner form edges may be formed with no extensions by appropriate piecing and manufacturing practice. In addition, septic tank inlet and outlet pipe insets typically molded into the vault are accommodated with reinforced cylindrical extensions for attachment to the inlet and outlet pipes.

In another important embodiment of the present invention, it is well known that it is difficult to obtain an inexpensive, liquid tight and long lasting seal between the inner, liquid holding cavity of a concrete vault and an inlet or outlet pipe. This difficulty is the natural result of attempting to form a liquid tight seal between the outside of an inlet or outlet pipe and the relatively smooth sides of a formed or drilled hole passing through the concrete wall. An attempt has been made with the frustro-conical piece 1306 of FIG. 13 (which are known to have dimensions of frustrum top of about 4 inches and bottom of about 7 inches diameter), as is well known in the art, to place such a piece in the casting mold of a concrete vault so as to provide a hole through one of the low liquid pressure containing walls of the concrete vault for the inlet or outlet pipes and thereby form a concrete-to-frustro-conical piece bond with the hope that such a bond will remain liquid tight upon forming a liquid tight seal between the outside of the pipe and the inner surface of the frustro-conical piece. The embodiment of the present invention shown in FIGS. 13 and 14 avoids the difficulty altogether. The liquid tight liner 1305 of the present invention for concrete vaults and septic tanks is provided with a hole, around which is sealed by rf-welding or adhesives a base section 1304 which extends to a frustroconical section 1302 and then to a cylindrical section 1301, the continuous assembly of which forms pipe sealing adaptation 1300. Adaptation 1300 is shown in FIG. 13 with the section 1301 pointed in a direction such that frustro-conical piece 1306 will easily slide over section 1301 and match its inside surface with the outside surface of section 1302, as in FIG. 14. Pipe 1308 is moved into a position within the section 1301 such that a common banding or strapping piece about the outside of section 1301 will provide a fully effective liquid seal between the inlet or outlet pipe and the liquid tight liner 1305 of the present invention. As such, it is clear that no concrete-to-pipe exterior seal is needed to retain liquid within the concrete vault or septic tank. It is preferable for installation, material cost and effectiveness that the material of adaptation 1300 be of the same material as that of liner 1305. The adaptation 1300, being of flexible material, can be inverted, so as to permit installation of the liner material-to-pipe seal on either, with respect to the liquid containing cavity of the concrete vault, an inner or outer position, whereby in the inner position the adaptation 1300 is inverted and the outer surface of section 1301 in FIGS. 13 and 14 becomes the inner surface which is brought into relationship with the outer pipe surface for strapping sealment.

An alternative method of forming a pipe to liner seal is shown in FIGS. 15 and 16. In FIG. 15, a concrete side 1307 of an invention liner is shown with a reinforcing piece 1304 optionally overlaying that concrete side 1307, both layers having formed in them hole 1310 with a diameter effectively smaller than the diameter 1309 of pipe 1308. The method of forming the liner to pipe seal requires insertion of a leading end of pipe 1308 into hole 1310 along path 1311. As shown in FIG. 16, the invention liner is shown after securing attachment to the concrete wall, shown in cross section at the hole formed therein for inlet or outlet pipe 1308. An interior side 1312 of the invention liner is compressed with ring

1313 which is shown in cross section and is understood to be a ring support device capable of holding the liner to the wall of the concrete tank during the seal forming process. As pipe 1308 is inserted into hole 1310, the flexible liner material forms a seal section 1314 about the outer circumference of pipe 1308 in the direction of the insertion of the pipe 1308. The seal section 1314 may be sufficient alone for sealing purposes or may be supplemented with an optional pipe clamp or equivalent device 1315 shown in broken lines. Device 1313 is removed after pipe 1308 has about it formed seal section 1314.

It can now be appreciated that, in contrast to the prior art, the flexible liner of the present invention as applied to concrete vaults eliminates the need for liquid containment by the concrete structure, at least initially. This advance solves an especially difficult problem with respect to septic tank testing which requires that the sealed septic tank maintain a vacuum for a specified length of time. While the prior art concrete vault, when carefully made, could barely pass such tests due to the tendency of concrete to form micro-cracks that permit air to leak into the vault, the liner of the present invention as applied to such a pre-cast or cast in place septic tank easily passes such a test. The effectiveness of the present liner in retrofit, pre-cast or cast in place concrete vaults improves with the anchoring means described above. The flexible extensions of the liner described above may also be used in a retrofit if scoring of the concrete surface is made along the path desired for securement of the liner to the concrete wall, whereby concrete grout is applied and the flexible extensions are pressed therein while the grout is still wet and uncured.

In yet another embodiment of the present invention, the liner to be applied to a mold in a pre-cast concrete vault may be fabricated such that its length and width are equal to or smaller than the inside mold piece, whereby moderate heating or physical stretching of the flexible material permits easy installation on the mold as described above. Once the "memory" of the flexible materials causes the liner to tend to its original size before heating or stretching, the liner forms a tightly stretched cover over the mold. The resulting product is visually impressive and desirable for the buyer, giving the impression not of a concrete vault, but rather of a glossy liquid container. The tension of the stretched liner also improves the tendency of the flexible extensions to self-insert into the concrete poured into the mold as described above.

It is known to use concrete vaults for casket containment in below ground internment. The liner of the present invention as applied to these pre-cast vaults may be made with a variety of designs, colors, pictures or the like to accommodate the preference of the bereaved when viewing the lowering of the casket into the burial vault. The use of flexible vinyls with this embodiment makes application of such visual effects within the skill of the art of such flexible materials.

In addition, a liner as described above may be effectively provided for the outer surface of the foundation of a structure to prevent soil attack on the concrete. It is taught herein that the flexible extensions of the present invention as applied to a flexible liner have not been heretofor used or proposed for application for attachment to concrete flowed about them. It is known in the art to use adhesives on flexible materials so that they bond to wet concrete flowed onto such a surface when the concrete dries. The present invention eliminates the need for such application of adhesives, which effectiveness is clearly time-limited under the circumstances of the chemical and temperature conditions of the surroundings. The present invention, on the other hand, is substantially independent of time, heat or chemical conditions with respect to the mechanical impression securement of the flexible extension of the liner into its adjacent concrete. As such, the location of the liner may be effectively made on the exterior or interior, irregardless of frame of orientation of such inside or outside surfaces, of any flowed concrete structure so long as the flexible extensions may be held within the concrete until it cures at the surface portion surrounding the flexible extensions.

The embodiment of FIG. 7A describes a method known in the art of forming two pre-cast concrete vaults with adaptation to fit them together at multi-level rims and so to form a "stacked" set of vaults with a vertical height equal to the stacked height. The top vault, for a description of this embodiment, is continuously molded similar to a bottom vault, although the top vault is inverted so that no lid is needed, i.e., the "bottom" of the vault forms a ceiling for the stacked vaults and extends continuously to the vertically descending walls. Another embodiment of the present invention relates to the molding and use of the top vault for securement of the liner of the present invention with relationship to stacked vaults. Before the molding of the top vault, a "collar" or continuous rounded or rectangular cross-section inset piece is secured to the concrete containing wall of the inner mold so that it runs about that inner mold wall in a substantially horizontal plane about at the level of the highest side reinforcing rebar cross-section 409 shown in FIG. 7. The material of the inset piece is preferably inexpensive although with sufficient strength to permit attachment and support therefrom the 404' EDGE of the liner of FIG. 7A when drawn upward into the stacked structure. Such inset piece material includes rigid polyurethane foam, foamed rubbers, rubber or elastomeric or rigid polymeric material. When the top vault is removed from the mold, an inner surface of the inset piece will be exposed on the inner surface of the side wall of the upper vault, while the inset piece itself will be secured into the cured sidewall of the top vault. Thus, an inexpensive and effective means are formed for quick installation of 404' EDGE to the inside of the top vault by either having in the inner surface of the inset piece a race or other slot for insertion and securement of the flexible material of the liner or having sufficient thickness in the inset piece to accommodate piercing the liner material for installation with screws or other such standard securing means.

A composition for a liner for a concrete septic tank lined according to the present invention is known as a material EUO000 T030D016 of Achilles USA, Inc. A preferable embodiment of this material comprises a gauge of 30 mil, a hand of 5S, and the following physical properties:

| | | |
|---|---|---|
| Tensile Strength: | M | 1840 |
| ASTM D-882 (PSI) | T | 1620 |
| ELONGATION: | M | 276 |
| ASTM D-882 (%) | T | 274 |
| 100% MODULUS: | M | 1110 |
| ASTM D-882 (PSI) | T | 1040 |
| GRAVES TEAR: | M | 283 |
| ASTM D-1004 (LB/IN) | T | 235 |
| VOLATILITY: 72 HRS | | .92 |
| ASTM D-1203 (%) | T | 1620 |
| DIMENSIONAL STABILITY | 50° C. | 100° C. |
| ASTM D-1204 (%): | T −.8 | −2.8 |

-continued

| | | |
|---|---|---|
| 10 MIN. | M .4 | 1.2 |
| COLD IMPACT: | | |
| ASTM D-1790 | −20° F. | FAIL |

It is a further embodiment of the present invention to thermally embed or adhesively attach to a concrete-side of the liner material a flat and flexible fibrous material, such as natural burlap or equivalent synthetic materials, prior to embedment and/or drying and/or adhesive attachment of the liner material to wet, uncured concrete or cement. The effective adhesion of this fibrous material improves the securement of the flexible liner to the drying concrete or cement. It is known in the art that certain adhesives will effect an adhesive secure connection between a flexible polymer sheet material and uncured, flowable cementitious material. It is a further embodiment of the present invention to have previously applied such adhesives to the concrete-side of the liner of the present invention. It is also known in the art that other adhesives bond a flexible sheet of polymer material to another such sheet. It is another embodiment of the present invention to provide for sealing liner connection between stacked concrete sections of septic tank or concrete tanks via other adhesive sealing of the liner of one section to an overlapping section of another. As a further example of this method, a septic tank has a "lid" piece which acts a sealing roof for the septic tank, whereby for this invention an invention liner is attached to the interior (as to the septic tank) portion of the lid with sufficient overlap to be chemically adhered to an invention liner of the next lowest section of the septic tank, thereby forming an entire seal against the concrete of the tank protecting it from the liquids and gases of the interior of the tank which may attack the concrete of the tank.

As to the present invention in its several embodiments, it is disclosed herein that the presence of a flowable cementitious material, either with or without conglomerate forming concrete, is a critical step in the process of forming a secure attachment of the invention liner to the surface of the later cured cementitious material. The methods and assemblies disclosed herein for accomplishing that sealing attachment of a flexible liner have not heretofor been disclosed in the art. Septic tank liners may have a liner thickness of about 30 mil, whereas larger catch basins may have a liner thickness of about 50–60 mil.

Concrete walls are used in many enclosures. Catch basins, manhole surface to pipe transition pieces, clarifiers (as in oil/water separators or other such process separators), holding stations, grease traps, burial vaults and lift stations are all well known to have been widely comprised of pre-formed concrete structures which are appropriate for adaptation in the casting processes for application of the invention liner on the inside or outside surfaces for protection of the concrete from the interior liquids and gases as well as the external ground water, bacteria and gases.

Although the present description describes the use of molds for cementitious vault sections to form septic tanks and similar ground vaults, the definition of such molds extends to the use of enclosures such as building foundation forms (with a floor on of the ground), tilt-up pre-cast wall forms and their molds, frustro-conical molds for manhole to pipe transition pieces, and the many other assemblies and methods for enclosing the flowable mass of cementitious material which is intended to form a vault section. A vault section is more specifically at least a wall which continuously encircles a central space, the central space having (1) no floor or ceiling as in a large diameter pipe with a vertical axis, (2) having a floor but no ceiling as in a septic tank base piece, or (3) having a floor and a ceiling with sufficient opening at some wall portion to introduce flowable cementitious material.

The present invention comprises additional embodiments as disclosed below with respect to FIG. 17 and higher, although reference is also incorporate as to the art of septic tanks as disclosed above.

Figure 23:
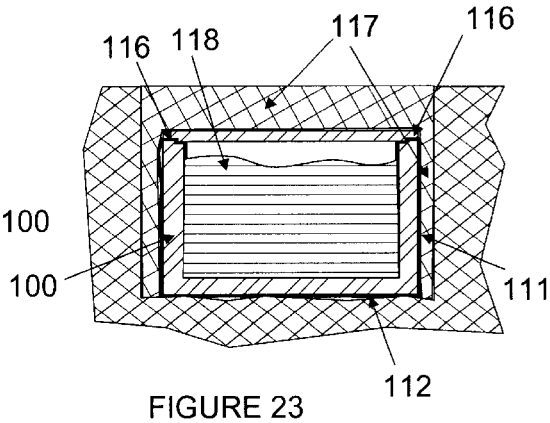
FIG. 23 is the structure of FIG. 22 with liquid in the cavity and earth filling the excavation excepting the container and lid.

FIG. 17 shows a concrete septic tank 100 rests in excavation 102 having a floor 103 and whose surfaces are potentially subjected to water table levels 104–107. Although septic tank installation requires a water table substantially lower than level 107, i.e., above the filled level of the septic tank, such conditions as an overly high water table may arise seasonally or after an especially prolonged rainy period. Concrete septic tanks typically have an unfilled weight of about 40 pounds per cubic foot totaling over 2000 pounds. The filled weight increases this total to over 5000 pounds. It is not been contemplated that a precast concrete vault as are used for septic tanks could be substantially sealed on their exterior walls with a relatively thin and flexible liner. The reason for this disincentive is clear. It has been thought that placing a thin and flexible liner 110 in excavation 102, as in FIGS. 18 and 19 (where the liner 110 is understood to be continuous and watertight as to the walls of excavation 102 before placing tank 100 on liner 110), would be completely ineffective in preventing escape of liquid from or invasion thereof into tank 100 through cracks that inevitably develop in such tanks due to the piercing and/or abrasion of a liner 110 as the sole layer between the outside sides 101 and floor of tank 100 and the adjacent floor 103 and backfill 117 as generally shown in FIG. 23. In other words, it was thought that such potential leak locations would render the liner 110 ineffective. No prior art has taught this application or led the skilled person to attempt it.

It is well known that pre-cast tanks 100 are lowered by crane or similar lifting device into an excavation 102 with requisite speed after excavation occurs. It is typical in most locations that price competition effectively prevents any additional cost for concrete septic tank sealing due to the lack low cost sealing methods and the resulting absence of laws or regulations enforcing leaks from septic tanks into the ground water.

The present inventor has found from extensive investigation, experience as a septic tank inspector and actual installations that a thin, flexible polymer liner 102 is an effective sealing means for a tank 100 placed in an earthen surrounding. Liner 102 is placed in excavation 102, tank 100 lowered on top of it as in FIGS. 18 and 19 such that liner 110 wraps around tank 100 bottom with section 112 and continuously up the sides 101 with collar-like section 111. On further installation, the liner 110 is pressed upon by the floor 103 across the bottom of tank 100 and backfill 117 presses upon by the section 111 across the sides 101 around the tank like a collar. So substantial are the large local zones of sealing as liner 102 is pressed onto the outside of tank 100 that punctures or abrasion tears that may typically occur in installation and backfilling are of little consequence since the local pressure sealing of the liner will not permit substantially leaking unless a potentially leaking fissure or crack in tank 100 occurs within about 2–3 feet of a large puncture or tear. The effect of local sealing is even more dramatic where water table is higher than level 104 the fluidized soil is of greater density than potentially leaking liquid in tank 100 and the sealing pressure of the fluidized soil on liner 102 causes surface form fitting of the flexible material of liner 110, pressing the liner into potentially leaking cracks or fissures. The means that even if a portion of a puncture coincides with a potentially leaking crack or fissure in tank 100, the denser fluidized soil will seal the rest of the puncture against leakage from fluid potentially travelling between the liner 110 and the outside of tank 100.

It has been found that this effective solution to leaking septic tanks is accomplished with little labor and low cost. The high cost and expensive labor of prior art alternatives have resulted in an almost complete lack of passage and/or enforcement of septic tank leakage into ground water. The present invention allows the installer to unfold a preferred polymer liner 102 of flexible sheeting PVC, medium density polyethylene, or similar materials from about 20 mils to 60 mils in thickness, arrange the liner in an excavation 102 in minutes after the excavation action so to prevent infilling by water from the water table, and set tank 100 into the liner-lined excavation cavity. The tremendous weight on section 112 and the later expansion and contraction about the sides 101 of tank 100 would cause a rigid liner to fracture. In the present invention, those forces have been found to improve the local sealing effect of liner 110 to the outside of tank 100. No prior art method or means has suggested that local sealing would result in such a manner for concrete septic tanks such that a single flexible polymer and waterproof liner would be effectively adequate to seal the outside of a septic tank against its earthen excavation location.

Figure 20:
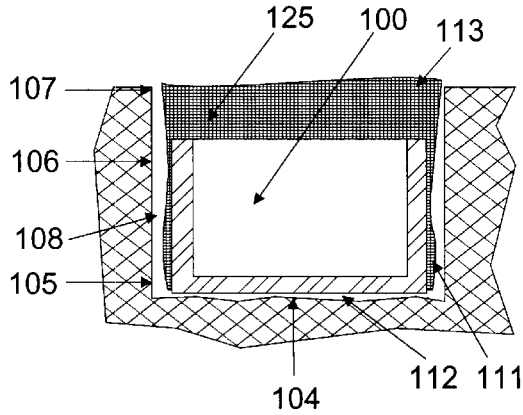
FIGS. 20 and 21 are respectively cutaway side and cutaway perspective views of a cement container resting in an excavation with its side walls surrounded by a liner.
Figure 21:
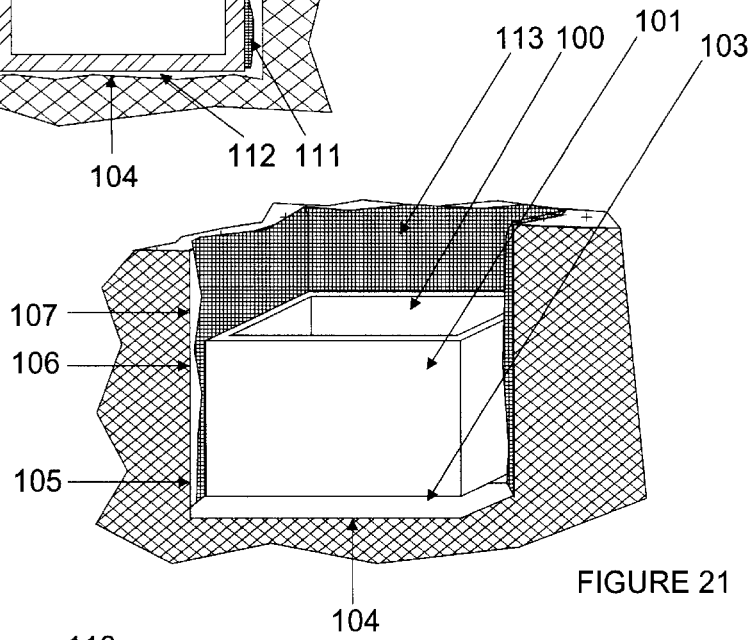

FIGS. 20 and 21 show a collar embodiment of the invention, where liner 113 has sections 111 that form a continuous collar around the sides 101 but the liner 113 lacks section 112 of liner 110 of FIG. 18. This embodiment obtains a substantial sealing effect against fissures and cracks that occur in the sides 101. However, the collar embodiment is especially useful for retrofitting existing concrete septic tanks where the tank 100 can be excavated to form clearance 108 around sides 101 and liner 113 can be inserted and backfilled without needing to lift the tank 100 out of the excavation.

Figure 22:
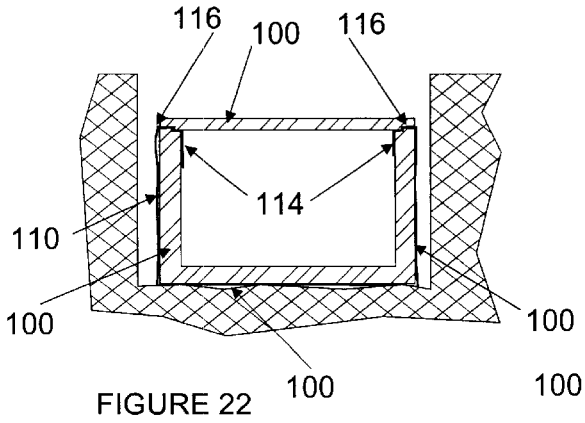
FIG. 22 is a side cutaway view of a container in an excavation with a liner surrounding its outside walls and folded over a top edge into the container cavity with a lid sealing the top edge.

It is known that concrete septic tanks comprise a lid 115 that sealingly connects with tank 100 at seat 116 as in FIG. 22. It is a further embodiment of the invention that before lid 115 is set in place in seat 116 that the top section 114 of liner 110 be folded to the inside of tank 100 such that it is pressed between seat 116 faces on setting of lid 115 in place. FIG. 23 shows that backfill 117 further compresses lid 115, thereby adding to the weight on section 112 of liner 110, demonstrating further disincentive for the skilled person to attempt a flexible liner 110 of the invention on so massive a tank 100 to effectively contain liquids 118.

Figure 24:
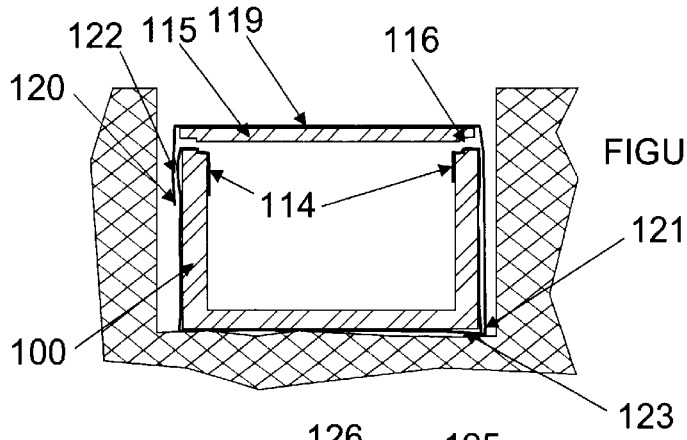
FIG. 24 is the structure of FIG. 22 with a watertight cap covering the lid and at least part of the outer side walls of the container.

FIG. 24 is a side view of a liner 110 substantially as in FIG. 22, although a top liner 119 is added as a continuous water tight cap over the combination of lid 115 and tank 100. The flexible material for the liner 119 is the same as that of liner 110. Liner 119 extends continuously across the top of lid 115 and over the top edges of tank 100 to form cap-like sides 120 or 121, which are shown in the same Figure although represent different embodiments of liner 119. Sides 120 are intended to extend to just below the top edges of tank 100 where double sided tape may be used to form a continuous seal 122 around sides 101. Alternately, sides 121 may extend so that their bottom edges are tucked under the bottom of tank 100 before it is set in place, thereby forming another type of continuous seal 123 against liner 110. Liner 119 provides additional protection from invasion of tank 100 from water at level 107 as in FIG. 20.

Figure 25:
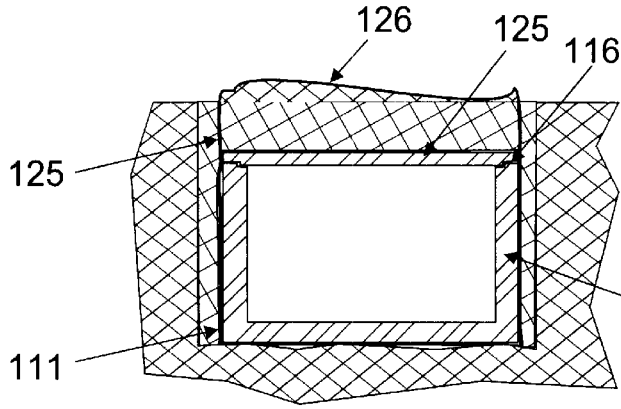
FIG. 25 is the structure of FIG. 21 where an upper section of the liner extends above the excavation.
Figure 26:
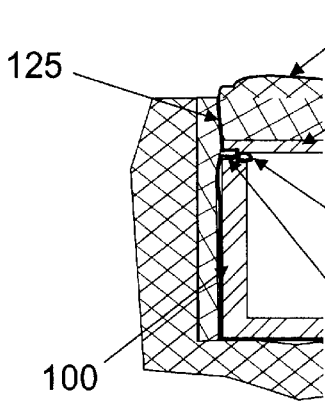
FIG. 26 is the structure of FIG. 25 except a portion of the upper section of the liner is trapped peripherally in between the lid and container.
Figure 27:
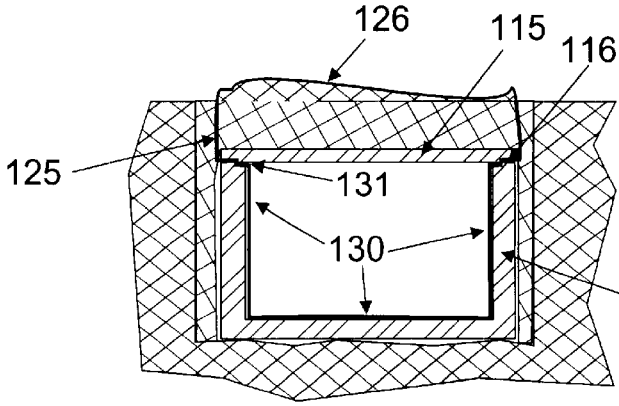
FIG. 27 is a flexible liner in the cavity of the container extending past a lid to container seal and above the excavation.

FIGS. 25 to 27 show embodiments also directed to preventing such invasion by water at level 107. Each of the liners 124, 127 and 129 have ground level edges 126 where the excavation lining sheeting is extended up from an effectively watertight enclosure for liquids 118 either inside or outside of tank 100 to the ground surface, forming a barrier at section 125 to water from level 107. FIG. 25 is an embodiment of a liner 124 substantially constructed and used as liner 110 in FIG. 23 except that section 114 is not folded into tank 100 through seat 116 but is instead backfilled so that it extends continuously upward to the ground surface. Figure is an embodiment of a liner 127 substantially constructed and used as liner 110 in FIG. 25 except that a portion 128 is folded into seat 116 to provide additional sealing means thereto.

FIG. 27 is an embodiment of the invention with a liner 129 constructed as liner 110 except that it is inserted into tank 100 to form a water tight lining for liquids 118 with sections 130 such that liner 132 extends at section 131 through seat 116 up to section 125 and edge 126. It will be appreciated that back fill as shown for FIGS. 25–27 is made in practice so that the flexible liners obtain the upward extensions shown.

It is well known in the art that concrete septic tanks have a top that sealingly engages an upper rim of the septic tank against earth intrusion. However, the connection between tank and top is not liquid tight. As described above, in high ground water conditions, water intrudes into the tank through this connection. The present invention also comprises a method for installation of a liner 124. In this embodiment, the liner 124 is inserted into the excavation, the concrete tank is placed in the excavation on the liner, and the tank top is installed with an access shaft integral therewith extending from a location on the tank top to an elevation above ground level. Liner 124 has substantial excess of material above the level of the tank top. This excess is brought close to and banded to the outer circumference of the access shaft so that a single impermeable envelope is created from the access hole opening at the top of the access shaft all about the access shaft, tank top and tank, thereby eliminating substantial ground water intrusion into the tank. Substantial pressurization of the tank is eliminated by passage of generated gases into the leaching field through the tank outlet. It has not been previously thought possible to achieve this in situ envelope about a concrete septic tank.

The above design disclosures present the skilled person with considerable and wide ranges from which to choose appropriate obvious modifications for the above examples. However, the objects of the present invention will still be obtained by the skilled person applying such design disclosures in an appropriate manner.

I claim:

1. A process for forming a substantially waterproof barrier for at least the outer lateral sides of a pre-cast concrete container with a tank cavity adapted so that liquid is initially containable in at least 50 percent of an inside volume of the tank cavity, where the container is to be placed in an earthen excavation adapted to bury the container comprising:

(a) a flexible, waterproof liner comprising polymer sheeting, flexible lateral sides adapted to sealingly enclose at least the lateral sides of the liner continuously from a bottom edge of the container to at least a top edge of the container, thereby forming a top opening in the liner with a top edge, the inside volume of the liner being larger than the volume defined by the outer sides of the container;

(b) placing the liner in the excavation before placing the container therein;

(c) placing the container in the excavation so that it is sealingly enclosed on at least the lateral sides by the liner;

(d) sealingly placing a lid on the container; and (e) filling the remaining excavation space with non-bindable, porous material.

2. The process of claim 1 wherein the liner further comprises a liner bottom sealingly continuous with the flexible lateral sides and adapted to lie between a floor of the excavation and a tank bottom, whereby the process further comprises placing the container in the excavation on the liner bottom at a tank placement step.

3. The process of claim 2 wherein the flexible lateral sides extend above a top edge of the container to form a flexible top section and before placing the lid on the container the top section is folded into the tank cavity such that the lid to tank seal is enhanced thereby.

4. The process of claim 1 wherein a thickness of the liner is from about 20 mils to 60 mils.

5. The process of claim 1 wherein the flexible lateral sides extend above a top edge of the container to form a flexible top section and before placing the lid on the container folding the flexible top section into the tank cavity such that the lid to tank seal is enhanced thereby.

6. The process of claim 1 wherein the flexible lateral sides extend above a top edge of the container to form a flexible top section so that after a remaining excavation space is filled with non-bindable, porous material the top edge is substantially at ground level.

7. A process for forming a substantially waterproof barrier for at least the outer lateral sides and bottom of a pre-cast concrete container with a tank cavity adapted so that liquid is initially containable in at least 50 percent of an inside volume of the tank cavity, where the container is to be placed in an earthen excavation adapted to bury the container comprising:

(a) a flexible, waterproof liner comprising polymer sheeting, flexible lateral sides extending from a liner bottom, the combination adapted to sealingly enclose at least the lateral sides and bottom of the liner, thereby forming a top opening in the liner with a top edge, the inside volume of the liner being larger than the volume defined by the outer sides of the container;

(b) placing the liner in the excavation before placing the container therein;

(c) placing the container in the excavation so that it is sealingly enclosed on at least the lateral sides and bottom by the liner;

(d) sealingly placing a lid on the container; and (e) filling the remaining excavation space with non-bindable, porous material.

8. The process of claim 7 wherein the flexible lateral sides extend above a top edge of the container to form a flexible top section and before placing the lid on the container the top section is folded into the tank cavity such that the lid to tank seal is enhanced thereby.

9. The process of claim 7 wherein a thickness of the liner is from about 20 mils to 60 mils.

10. The process of claim 7 wherein the flexible lateral sides extend above the top edge of the container to form a flexible top section so that after the remaining excavation space is filled with non-bindable, porous material the top edge is substantially at ground level.

11. The process of claim 7 wherein the flexible lateral sides extend above the top edge of the container to form a flexible top section so that after the remaining excavation space is filled with non-bindable, porous material the top edge is substantially at ground level.

12. The process of claim 7 wherein before the remaining excavation space is filled with non-bindable, porous material a flexible, waterproof cap comprising the material of the liner is placed such that the cap extends over a top surface of the lid and continues downward therefrom to below the top edge of the container.

13. The process of claim 12 wherein downward extensions of the cap reach to past bottom edges of the container and are located between a bottom of the container and the bottom of the excavation.

* * * * *